US006406082B1

(12) United States Patent
Telfer et al.

(10) Patent No.: US 6,406,082 B1
(45) Date of Patent: Jun. 18, 2002

(54) WASTE RETRIEVAL AND DISPOSAL DEVICE

(76) Inventors: Robert J. Telfer; Dawn D. Telfer, both of 808 School St., Waupaca, WI (US) 54981

( * ) Notice: Subject to any disclaimer, the term of this patent is extended or adjusted under 35 U.S.C. 154(b) by 0 days.

(21) Appl. No.: 09/732,548

(22) Filed: Dec. 8, 2000

(51) Int. Cl.[7] ..... A01K 29/00; E01H 1/12
(52) U.S. Cl. ..... 294/1.3
(58) Field of Search ..... 294/1.1, 1.3–1.5, 294/99.1, 87.1; 446/256, 368; 63/5.1, 11, 38

(56) References Cited

U.S. PATENT DOCUMENTS 3,746,099 A 7/1973 Black
4,558,784 A 12/1985 Wallis
4,578,291 A * 3/1986 Miner ..... 446/487
4,878,872 A * 11/1989 Johnson ..... 446/368
4,986,790 A 1/1991 Boury
D320,827 S 10/1991 Centafanti
5,064,233 A 11/1991 Sloan
5,564,763 A 10/1996 Mercurio
5,628,667 A * 5/1997 Levi ..... 446/368

FOREIGN PATENT DOCUMENTS

DE 3918-745 12/1989 ..... 294/1.3

* cited by examiner

*Primary Examiner*—Dean J. Kramer

(57) ABSTRACT

A waste retrieval and disposal device for providing a sanitary method of retrieving and disposing of a pet's feces. The waste retrieval and disposal device includes a flexible support line; and also includes a plurality of disc-shaped members being compressibly attached to the flexible support line for picking up a pet's feces.

10 Claims, 2 Drawing Sheets

WASTE RETRIEVAL AND DISPOSAL DEVICE

BACKGROUND OF THE INVENTION

1. Field of the Invention

The present invention relates to a pet feces disposal device and more particularly pertains to a new waste retrieval and disposal device for providing a sanitary means of retrieving and disposing of a pet's feces.

2. Description of the Prior Art

The use of a pet feces disposal device is known in the prior art. More specifically, a pet feces disposal device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,564,763; 3,746,099; 4,558,784; 4,986,790; 5,064,233; and Des. 320,827.

While these devices fulfill their respective, particular objectives and requirements, the aforementioned patents do not disclose a new waste retrieval and disposal device. The inventive device includes a flexible support line; and also includes a plurality of disc-shaped members being compressibly attached to the flexible support line for picking up a pet's feces.

In these respects, the waste retrieval and disposal device according to the present invention substantially departs from the conventional concepts and designs of the prior art, and in so doing provides an apparatus primarily developed for the purpose of providing a sanitary means of retrieving and disposing of a pet's feces.

SUMMARY OF THE INVENTION

In view of the foregoing disadvantages inherent in the known types of pet feces disposal device now present in the prior art, the present invention provides a new waste retrieval and disposal device construction wherein the same can be utilized for providing a sanitary means of retrieving and disposing of a pet's feces.

The general purpose of the present invention, which will be described subsequently in greater detail, is to provide a new waste retrieval and disposal device which has many of the advantages of the pet feces disposal device mentioned heretofore and many novel features that result in a new waste retrieval and disposal device which is not anticipated, rendered obvious, suggested, or even implied by any of the prior art pet feces disposal device, either alone or in any combination thereof.

To attain this, the present invention generally comprises a flexible support line; and also includes a plurality of disc-shaped members being compressibly attached to the flexible support line for picking up a pet's feces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new waste retrieval and disposal device which has many of the advantages of the pet feces disposal device mentioned heretofore and many novel features that result in a new waste retrieval and disposal device which is not anticipated, rendered obvious, suggested, or even implied by any of the prior art pet feces disposal device, either alone or in any combination thereof.

It is another object of the present invention to provide a new waste retrieval and disposal device which may be easily and efficiently manufactured and marketed.

It is a further object of the present invention to provide a new waste retrieval and disposal device which is of a durable and reliable construction.

An even further object of the present invention is to provide a new waste retrieval and disposal device which is susceptible of a low cost of manufacture with regard to both materials and labor, and which accordingly is then susceptible of low prices of sale to the consuming public, thereby making such waste retrieval and disposal device economically available to the buying public.

Still yet another object of the present invention is to provide a new waste retrieval and disposal device which provides in the apparatuses and methods of the prior art some of the advantages thereof, while simultaneously overcoming some of the disadvantages normally associated therewith.

Still another object of the present invention is to provide a new waste retrieval and disposal device for providing a sanitary means of retrieving and disposing of a pet's feces.

Yet another object of the present invention is to provide a new waste retrieval and disposal device which includes a flexible support line; and also includes a plurality of disc-shaped members being compressibly attached to the flexible support line for picking up a pet's feces.

Still yet another object of the present invention is to provide a new waste retrieval and disposal device that is easy and convenient to use and is readily disposable.

Even still another object of the present invention is to provide a new waste retrieval and disposal device that is very effective in picking up a pet's feces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
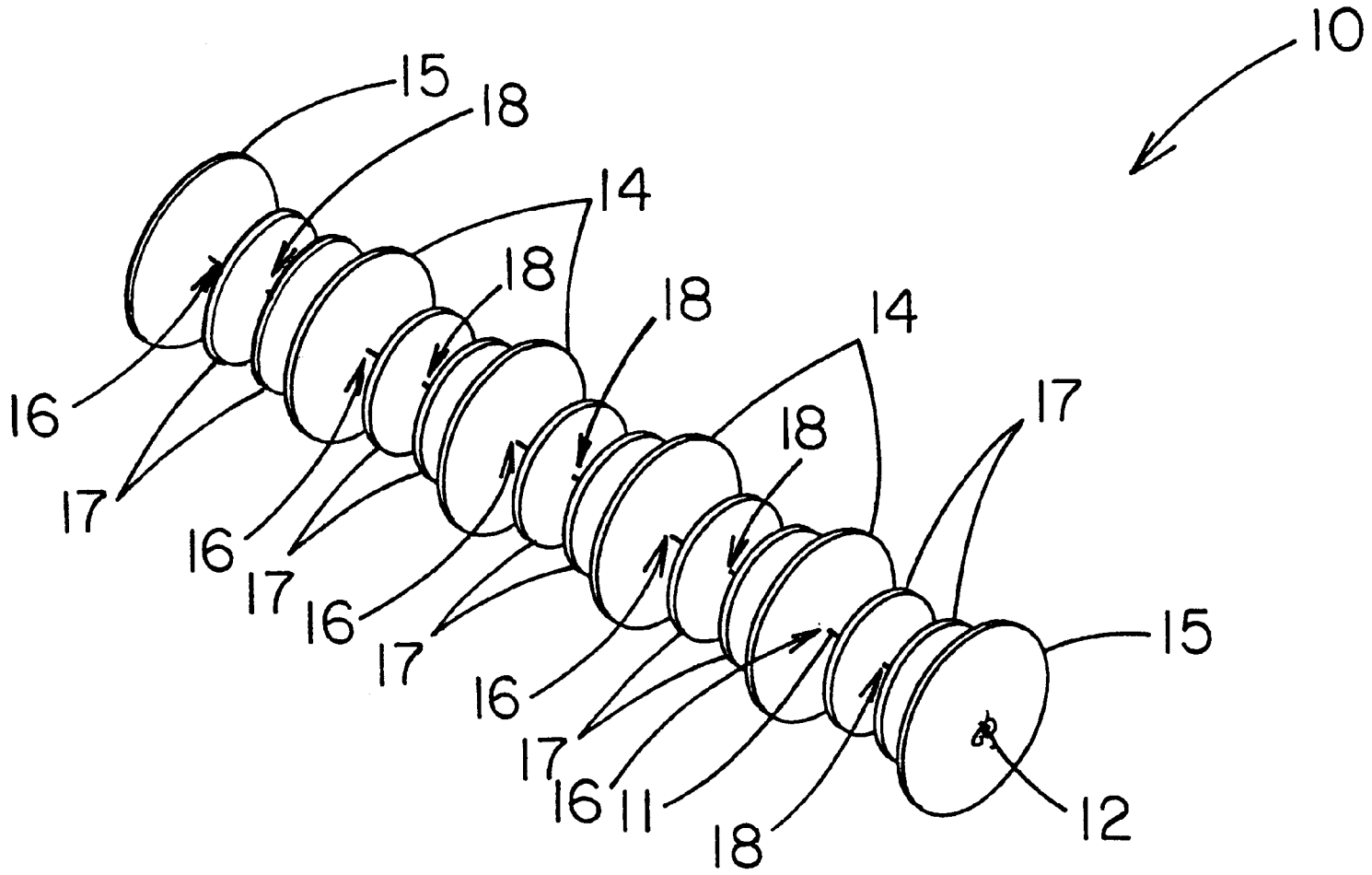
FIG. 1 is a perspective view of a new waste retrieval and disposal device according to the present invention.
Figure 3:
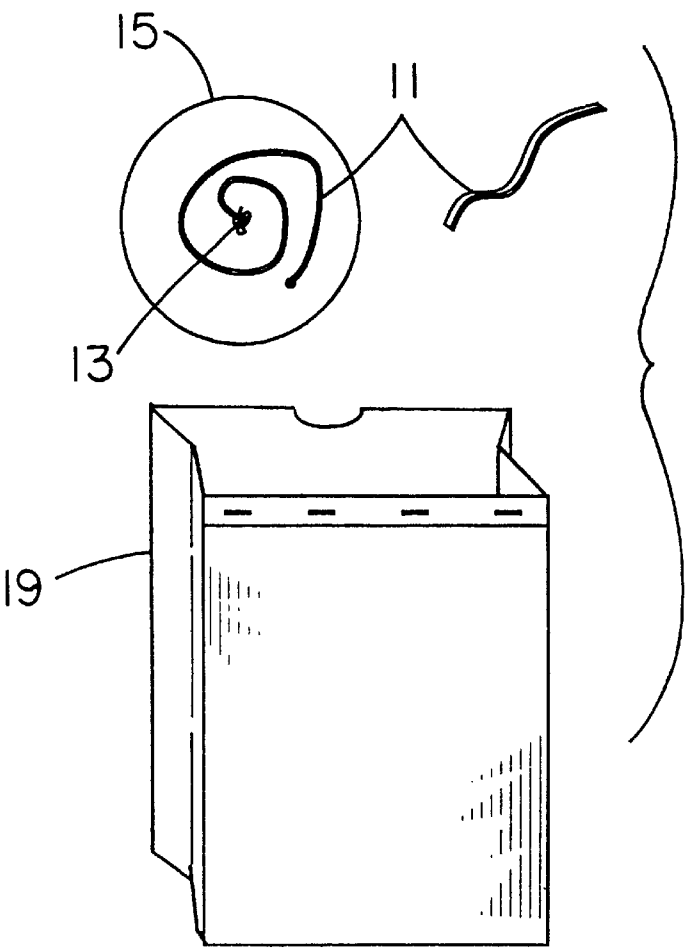
FIG. 3 is an exploded end elevational view of the present invention being discarded in a bag.
Figure 2:
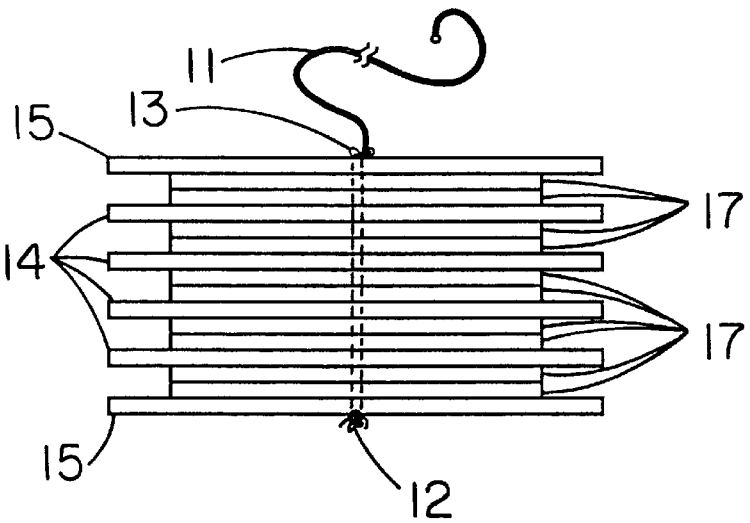
FIG. 2 is a side elevational view of the present invention.

With reference now to the drawings, and in particular to FIGS. 1 through 3 thereof, a new waste retrieval and disposal device embodying the principles and concepts of the present invention and generally designated by the reference numeral 10 will be described.

As best illustrated in FIGS. 1 through 3, the waste retrieval and disposal device 10 generally comprises a flexible support line 11. A plurality of disc-shaped members 14,15,17 are compressibly attached to the flexible support line 11 for picking up a pet's feces. Each of the disc-shaped members 14,15,17 has a hole 16,18 centrally disposed therethrough and being adapted to receive the flexible support line 11. The disc-shaped members 14,15,17 are arranged side-by-side and are in contactable relationship. The flexible support line has opposed knots 12,13 near ends thereof. The disc-shaped members 14,15,17 are tightly disposed between the opposed knots 12,13. The disc-shaped members 14,15,17 include first disc-shaped members 14,15 which are spaced along the flexible support line 11 and also include pairs of second disc-shaped members 17 which are disposed between the first disc-shaped members 14,15. Each of the second disc-shaped members 17 has a diameter smaller than that of each of the first disc-shaped members 14,15. The first disc-shaped members 14,15 further include end disc-shaped members 15 which are disposed at the knots 12,13 of the flexible support line 11. The disc-shaped members 14,15,17 are made of paper material including cardboard and are adapted to compress upon a pet's feces and to be disposed in a bag 19. Each of the first disc-shaped members 14,15 has a diameter of approximately 3½ to 4 inches, and each of the second disc-shaped members 17 has a diameter of approximately 2 to 3 inches. There are approximately 6 first disc-shaped members and 10 second disc-shaped members.

In use, the user places the disc-shaped members 14,15,17 upon the pet's feces which lying upon a ground, and the user then squeezes or compresses the disc-shaped members 14,15,17 together using the end disc-shaped members 15 thus engaging the pet's feces and allowing the user to dispose of the waste retrieval and disposal device 10 in the bag 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A waste retrieval and disposal device comprising:

a flexible support line; and a plurality of disc-shaped members being compressibly attached to said flexible support line for picking up a pet's feces;

wherein said disc-shaped members include first disc-shaped members which are spaced along said flexible support line and also include pairs of second disc-shaped members which are disposed between said first disc-shaped members, each of said second disc-shaped members having a diameter smaller than that of each of said first disc-shaped members.

2. A waste retrieval and disposal device as described in claim 1, wherein each of said disc-shaped members has a hole centrally disposed therethrough and being adapted to receive said flexible support line.

3. A waste retrieval and disposal device as described in claim 1, wherein said disc-shaped members are arranged side-by-side and in contactable relationship.

4. A waste retrieval and disposal device as described in claim 1, wherein said flexible support line has opposed knots near ends thereof, said disc-shaped members being tightly disposed between said opposed knots.

5. A waste retrieval and disposal device as described in claim 4, wherein said first disc-shaped members further include and disc-shaped members which are disposed at said knots of said flexible support line.

6. A waste retrieval and disposal device as described in claim 2, wherein said disc-shaped members are made of paper material including cardboard and are adapted to compress upon a pet's feces and to be disposed in a bag.

7. A waste retrieval and disposal device comprising:

a flexible support line; and a plurality of disc-shaped members being compressibly attached to said flexible support line for picking up a pet's feces;

wherein each of said disc-shaped members has a hole centrally disposed therethrough and being adapted to receive said flexible support line;

wherein said disc-shaped members are arranged side-by-side and in contactable relationship;

wherein said flexible support line has opposed knots near ends thereof, said disc-shaped members being tightly disposed between said opposed knots;

wherein said disc-shaped members include first disc-shaped members which are spaced along said flexible support line and also include pairs of second disc-shaped members which are disposed between said first disc-shaped members, each of said second disc-shaped members having a diameter smaller than that of each of said first disc-shaped members.

8. A waste retrieval and disposal device as described in claim 7, wherein said first disc-shaped members further include end disc-shaped members which are disposed at said knots of said flexible support line.

9. A waste retrieval and disposal device as described in claim 2, wherein said disc-shaped members are made of paper material including cardboard and are adapted to compress upon a pet's feces and to be disposed in a bag.

10. A waste retrieval and disposal device comprising:

a flexible support line; and a plurality of disc-shaped members being compressibly attached to said flexible support line for picking up a pet's feces, each of said disc-shaped members having a hole centrally disposed therethrough and being adapted to receive said flexible support line, said disc-shaped members are arranged side-by-side and in contactable relationship, said flexible support line having opposed knots near ends thereof, said disc-shaped members being tightly disposed between said opposed knots, said disc-shaped members including first disc-shaped members which are spaced along said flexible support line and also including pairs of second disc-shaped members which are disposed between said first disc-shaped members, each of said second disc-shaped members having a diameter smaller than that of each of said first disc-shaped members, said first disc-shaped members further including end disc-shaped members which are disposed at said knots of said flexible support line, said disc-shaped members being made of paper material including cardboard and being adapted to compress upon a pet's feces and to be disposed in a bag, each of said first disc-shaped members having a diameter of approximately 3½ to 4 inches and each of said second disc-shaped members having a diameter of approximately 2 to 3 inches, said first disc-shaped members including approximately six of said first disc-shaped members, said second disc-shaped member including approximately ten of said second disc-shaped members.

* * * * *